United States Patent [19]

Newton et al.

[11] Patent Number: 5,002,213

[45] Date of Patent: Mar. 26, 1991

[54] HARNESS KNIFE AND SHEATH

[76] Inventors: Thomas D. Newton, 136½ W. 2nd, Reno, Nev. 89501; Harold L. Hull, 401 Canyon Way #43, Sparks, Nev. 89434

[21] Appl. No.: 468,886

[22] Filed: Jan. 23, 1990

[51] Int. Cl.[5] ..... A45F 5/00; B26B 29/02

[52] U.S. Cl. ..... 224/232; 224/235; 224/241; 224/242; 224/901; 30/151; 30/162; 30/296.001

[58] Field of Search ..... 30/151, 162, 163, 296.1; 224/232, 233, 236, 240, 241, 242, 245, 124, 225, 228, 901, 904

[56] References Cited

U.S. PATENT DOCUMENTS

| | | | |
|---|---|---|---|
| 2,398,764 | 4/1946 | Bailey | 224/232 X |
| 2,439,197 | 4/1948 | Wykoff | 224/246 X |
| 2,528,501 | 11/1950 | Davis | 224/232 |
| 2,859,516 | 11/1958 | McQueary | 224/232 X |
| 3,576,278 | 4/1971 | Eastman | 224/232 |
| 4,114,787 | 9/1978 | Rosenkaimer | 224/2 D |
| 4,178,681 | 12/1979 | Hanses | 30/151 |
| 4,211,003 | 7/1980 | Collins | 30/162 |
| 4,313,230 | 2/1982 | Chovaniec | 2/322 |
| 4,404,747 | 9/1983 | Collins | 30/151 |
| 4,414,744 | 11/1983 | Collins | 30/151 |
| 4,523,379 | 6/1985 | Osterhout | 30/151 |
| 4,558,516 | 12/1985 | Collins | 30/151 |
| 4,690,316 | 9/1987 | Peterson | 224/901 X |
| 4,720,030 | 1/1988 | Petrovich | 224/232 |
| 4,726,498 | 2/1988 | Esposito | 224/232 |
| 4,759,483 | 7/1988 | Willoughby | 224/232 X |
| 4,835,863 | 6/1989 | Salandre | 30/151 X |
| 4,856,192 | 8/1989 | Collins | 30/151 |

*Primary Examiner*—Ernest G. Cusick

[57] ABSTRACT

A knife and sheath combination in which the sheath may be attached in and inverted position on a harness strap such as a shoulder holster or backpack strap by screws and the knife held in the sheath with a quick release. The sheath may also be attached to clothing by use of VELCRO and may also have a safety strap to keep the knife in the sheath, along with a striker affixed to the sheath.

14 Claims, 1 Drawing Sheet

HARNESS KNIFE AND SHEATH

This invention relates to knives and means to hold knives in a sheath and more particularly to an arrangement of a knife cooperating with a sheath, with the sheath being attached to a harness strap or the like.

BACKGROUND OF THE INVENTION

In the past many arrangements have been saught to provide means to carry a knife in a sheath with the sheath being attached to a belt or the like, however most arrangements require the knife blade to be pointed downward whereby the knife is retained in the sheath by gravity and friction. When the knife or even a pistol is supported in and inverted position such as U.S. Pat. No 4,068,784, snaps or spring loaded means are required to keep the pistol or knife in place.

U.S. Pat. No. 4,211,003 shows an arrangement whereby the knife is held in an inverted position similar to the present invention with the sheath being attach to a harness by means of a buckle with a hole in the knife to engage a release pin, which requires the buckle to be fabricated with the harness and a special knife with a hole and a spring loaded pin.

U.S. Pat. No. 4,726,498 relies on a leather latch arrangement which is unsuitable for use in an inverted position.

Again, U.S. Pat. No. 4,404,747 teaches a knife designed for use underwater by a diver and requires a spring loaded detent built into the knife.

While many knives and sheath combinations have been #proposed, none of them teach a simple one piece sheath construction cooperating with a knife to hold the knife in an inverted position and simple means to attach the sheath to any shoulder strap or article of clothing.

SUMMARY OF THE INVENTION

A primary object of the invention is to provide a one piece sheath which can be molded from plastic or other resilient material such as hard rubber that does not depend on a separate mechanism to hold the knife and sheath together.

Another object is to provide a knife sheath for releasably securing a knife therein.

Yet another object is to provide a striker on the sheath to provide a means to make sparks for lighting a fire when the knife blade is struck sharply against it.

An additional object is to provide a knife sheath that automatically locks the knife in the sheath so as to prevent accidental loss of the knife.

Still another object is to provide a quick release that can be activated by the thumb with the hand and fingers grasping the handle ready for instant use.

Another object is to provide an additional safety strap which is attached to the knife handle and hooks over the top of the sheath when desired.

Yet another object in a second embodiment is to provide a knife and sheath combination whereby the locking and release mechanism is a rounded blade guard and a mating indent in the sheath which requires a pull of approximately 5 lbs. to remove the knife.

Another object is to provide a knife that can be locked into a sheath without having to put holes or detents in the knife but simply uses the blade guard as the holding device.

Yet another object is to provide means to removably attach the sheath to any strap or article of clothing.

Another object is to provide a knife and sheath combination that is flat in design and can lay unobserved on a strap with out an obvious bulge through outer clothing.

To the accomplishment of the above and related objects, this invention may be embodied in the form illustrated in the accompanying drawings, attention being called to the fact, however, that the drawings are illustrations only and that departures and changes may be made in the specific construction illustrated and described within the scope of the claims.

DETAILED DESCRIPTION OF THE DRAWINGS

Figure 1:
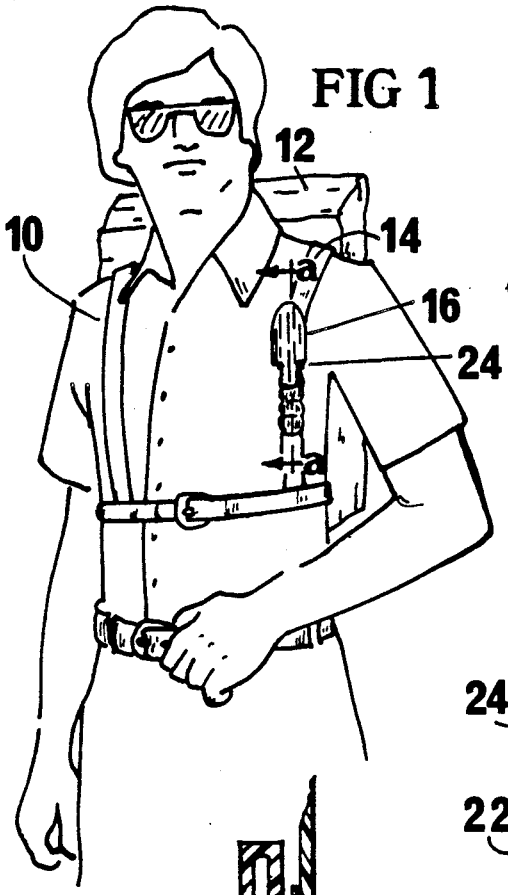
FIG. 1 is a perspective view illustrating the knife and its sheath attached upside down on a backpack strap.
Figure 3:
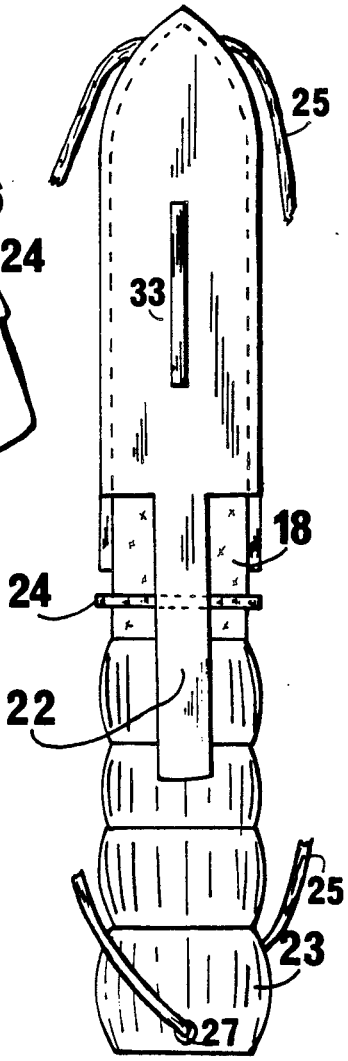
FIG. 3 is a side view with phantom lines showing the blade of the knife in its sheath with a broken view of a safety strap in place and a striker attached to the sheath.
Figure 2:
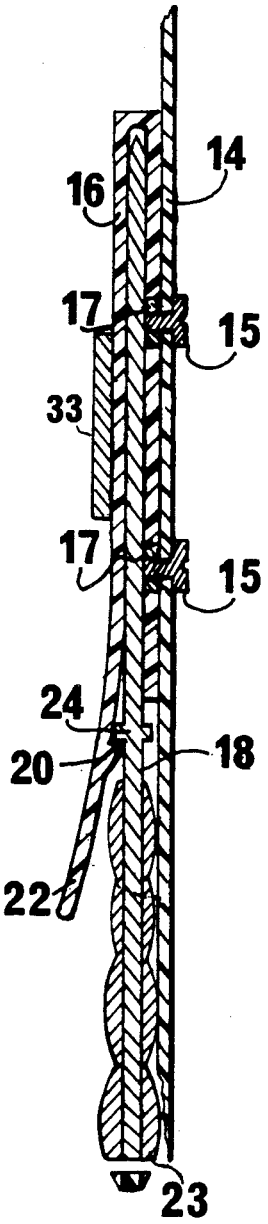
FIG. 2 is a section taken at a—a of FIG. 1.

Referring now in detail to the drawings wherein like numerals throughout the various views refer to like parts, 10 is an overview of a person wearing a backpack 12 with shoulder harness 14, and sheath 16 attached to the left shoulder strap of the harness 14 by screws 15 and nuts 17, the nuts 17 being embedded in the plastic sheath or threads may simply be molded in the plastic, while 18 is the knife held in the sheath by the abutment 20 which is an intricate part of the extension portion 22 of the sheath and formed of the same material at the time of manufacture, the material of the sheath being made of a resilient material such as plastic or hard rubber or the like so that the extension portion 22 has a first and second position. The first position is shown by FIG. 2 with the knife being held in place. 23 is a knife handle while 24 is a blade guard on the knife which has two adjacent sides that the abutment 20 and extension portion 22 cooperate with to releasably hold the knife in the sheath. 25 is a safety strap running through hole 27 in the knife handle 23 and looping tightly over the point of sheath 16, while 33 is a striker which is made of metal or flint which can be affixed to the sheath by gluing or molding.

Figure 4:
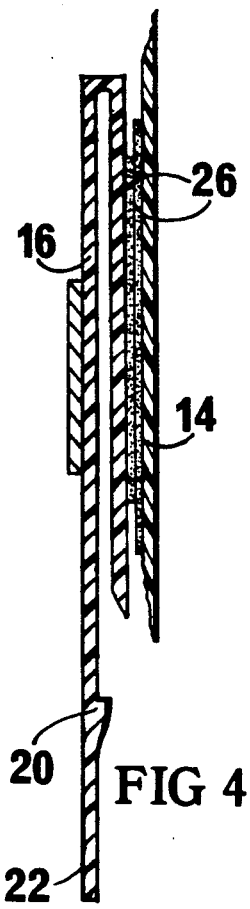
FIG. 4 is a section taken at a-a showing the sheath without the knife in place and using a second embodiment for attaching the sheath.
Figure 5:
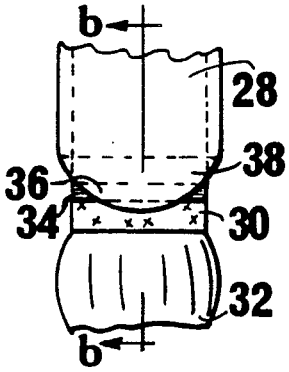
FIG. 5 is a second embodiment showing a side view with phantom lines.
Figure 6:
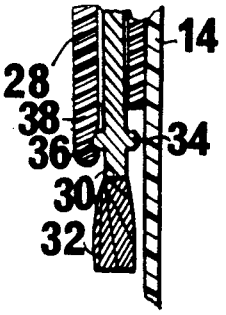
FIG. 6 is a section taken at b—b of FIG. 5.

FIG. 5 and FIG. 6 show a second embodiment with 28 being the sheath, 30 being the knife, 32 the knife handle and 34 being a blade guard with two adjacent sides, each side having a raised boss with rounded edges to mate with the indent 36 in the lip 38 of the sheath 28, lip 38 being substantially in the form of a half circle. Also, FIG. 4 shows the sheath being fastened to the harness 14 by a second fastening method 26, which is a fastener of the loop and pile variety such as "VELCRO". "VELCRO" allows the sheath to be fastened to different surfaces such as clothing or the like.

When the sheath is fastened in place by either "VELCRO" 26 or screws and nuts, 15 and 17 respectively, the knife 18 is inserted into the sheath and the blade guard 24 engages the abutment 20 and opens the sheath extension portion 22 to it's second position and when the blade guard 24 passes the abutment 20, the abutment snaps over the blade guard and being in a tensioned state holds the knife firmly in the sheath.

In the preferred embodiment, when it is desired to use the knife 18, the thumb of the right hand (in this case) is inserted under the extension portion 22, and lifts the extension portion 22, which pulls the abutment 20 away from the blade guard 24, which allows the knife to be released from the sheath at the same time the hand grasps the handle of the knife.

In a second embodiment as shown in FIG. 5 and FIG. 6, when it is desired to use the knife 30, the handle 32 is simple grasped and approximately a 5 lb. pull releases the knife. No thumb or other release mechanism is used or necessary.

It will now be seen that we have provided a one piece sheath that can be injection molded with no other parts being necessary and a knife that is releasably held in the sheath in an inverted position which can be quickly grasped and disengaged from it's sheath. Also, we have provided two embodiments for attaching the sheath to any portion of a garment or strap so that the sheath can be used on several different articles of clothing or various straps as required. A safty strap and a striker is also provided.

Although the invention has been herein shown and described in what is conceived to be the most practical and preferred embodiment, it is recognized that departures may be made therefrom within the scope of the invention, which is not to be limited to the details disclosed herein but it is to be accorded the full scope of the claims so as to embrace any and all equivalent devices and apparatus.

Having described our invention, what we claim as new and desire to secure by letters patent is:

1. A knife and sheath assembly comprising; A knife including a blade, a blade guard and handle; a sheath, said sheath having an open end to receive said blade, an extension on said sheath, said extension having a raised boss, said extension having a first and second position, said extension in it's first position being un-tensioned when said knife is out of said sheath, said extension being deformed into a tensioned second position when said knife is inserted into said sheath causing said raised boss on said extension to cooperate, engage and hold said blade guard, said knife and sheath being locked together when said extension is in it's second position, mounting means to mount said knife and said sheath upside down with said knife handle below said sheath, said sheath being formed of one piece of material, said one piece of material being resilient, and a safety strap, said safety strap being affixed to said knife handle and forming a closed loop with one end of said loop fitting tightly over the top end of said sheath and cooperating with said sheath to hold said knife securely in place when desired.

2. The assembly of claim 1 in which said mounting means to mount said knife and said sheath, is at least one screw and held and engaged by a nut, said nut being embedded in said sheath.

3. The assembly of claim 1 in which said means to mount said knife and said sheath upside down is of the loop and pile variety, such as VELCRO.

4. The assembly of claim 1 in which said material for forming said sheath is plastic.

5. The assembly of claim 1 in which said material for forming said sheath is hard rubber.

6. The assembly of claim 1 with a striker added, said striker having means to be affixed to said sheath, said striker cooperating with said knife to produce sparks when said knife is struck sharply against said striker.

7. The assembly of claim 1 in which said means to affix said striker to said sheath is by molding.

8. A knife and sheath assembly comprising; A knife including a blade, a blade guard and handle, said blade guard having two adjacent sides, a sheath, said sheath leaving an open end to receive said blade, an extension on said sheath in the configuration of a half-circle, said half-circle covering the width of said sheath, said extension having an elongated indent, said blade guard having on it's said two adjacent sides, raised bosses, said raised bosses having rounded edges, said raised bosses mating with said elongated indent on said sheath extension, said blade guard cooperating with said extension to releasably hold said knife and said sheath together, allowing said knife to be removed from said sheath with an approximate 5 lb. pull, mounting means to mount said knife and said sheath upside down with said knife handle below said sheath, a safety strap, said safety strap being affixed to said knife handle and forming a closed loop with one end of said loop fitting tightly over the top end of said sheath and cooperating with said sheath to hold said knife securely in place when desired, said sheath being formed of one piece of material, and said one piece of material being resilient.

9. The assembly of claim 8, in which said mounting means of said knife and said sheath, is at least one screw and held and engaged by a nut, said nut being embedded in said sheath.

10. The assembly of claim 8 in which said mounting means to mount said knife and said sheath upside down is of the loop and pile variety, such as VELCRO.

11. The assembly of claim 8 in which said material for forming said sheath is plastic.

12. The assembly of claim 8 in which said material for forming said sheath is hard rubber.

13. The assembly of claim 8 with a striker added, said striker having means to be affixed to said sheath, said striker cooperating with said knife to produce sparks when said knife is struck sharply against said striker.

14. The assembly of claim 8 in which said means to affix said striker to said sheath is by molding.

* * * * *